US007351029B2

(12) United States Patent
Cattani

(10) Patent No.: US 7,351,029 B2
(45) Date of Patent: Apr. 1, 2008

(54) ROTARY VACUUM BLOWER

(75) Inventor: Ennio Cattani, Parma (IT)

(73) Assignee: Esam S.p.A., Parma (IT)

( * ) Notice: Subject to any disclaimer, the term of this patent is extended or adjusted under 35 U.S.C. 154(b) by 0 days.

(21) Appl. No.: 11/441,010

(22) Filed: May 26, 2006

(65) Prior Publication Data

US 2006/0269395 A1 Nov. 30, 2006

(30) Foreign Application Priority Data

May 31, 2005 (EP) ..... 05425394

(51) Int. Cl.
*F04D 5/00* (2006.01)

(52) U.S. Cl. ..... 415/47; 415/55.1; 415/116; 415/151; 415/155; 415/159

(58) Field of Classification Search ..... 415/55.1–55.7, 415/116, 47, 151, 155, 159
See application file for complete search history.

(56) References Cited

U.S. PATENT DOCUMENTS 1,797,293 A * 3/1931 McIlvaine ..... 415/159
2,603,411 A * 7/1952 Trumpa ..... 415/159
4,806,073 A * 2/1989 Schonwald ..... 415/55.1
5,248,238 A * 9/1993 Ishida et al. ..... 415/55.1
5,350,274 A 9/1994 Schmid et al.
5,569,023 A * 10/1996 Ishida et al. ..... 415/55.1

FOREIGN PATENT DOCUMENTS

| | | | |
|---|---|---|---|
| EP | 0 459 269 | | 12/1991 |
| EP | 0 636 792 | | 2/1995 |
| GB | 112181 | * | 1/1918 |
| GB | 2 126 652 | | 3/1984 |

* cited by examiner

*Primary Examiner*—Christopher Verdier
(74) *Attorney, Agent, or Firm*—Young & Thompson

(57) ABSTRACT

An impeller, set in rotation by a motor, provided with blades and enclosed in a casing which defines a circumferential annular conduit in which the blades turn. The annular conduit exhibits two openings, respectively an induction mouth for aspirating fluid from outside the machine, and a delivery mouth from which the fluid exits from the machine. The machine also comprises a further opening which is neither the induction mouth nor the delivery mouth, afforded on the casing and defining a passage which places an inside of the casing in communication with an outside environment.

5 Claims, 2 Drawing Sheets

Fig. 2
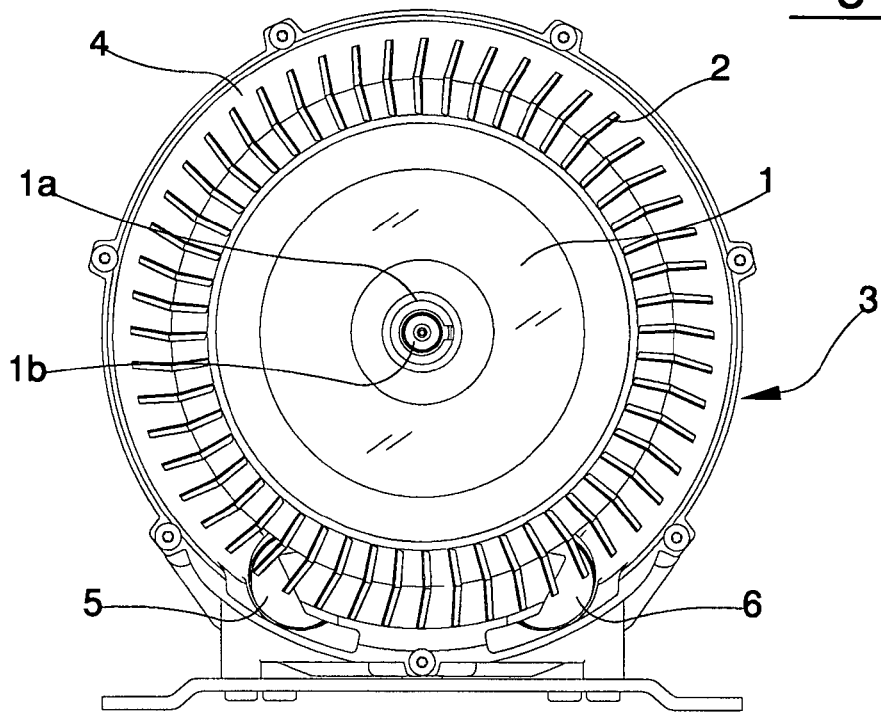
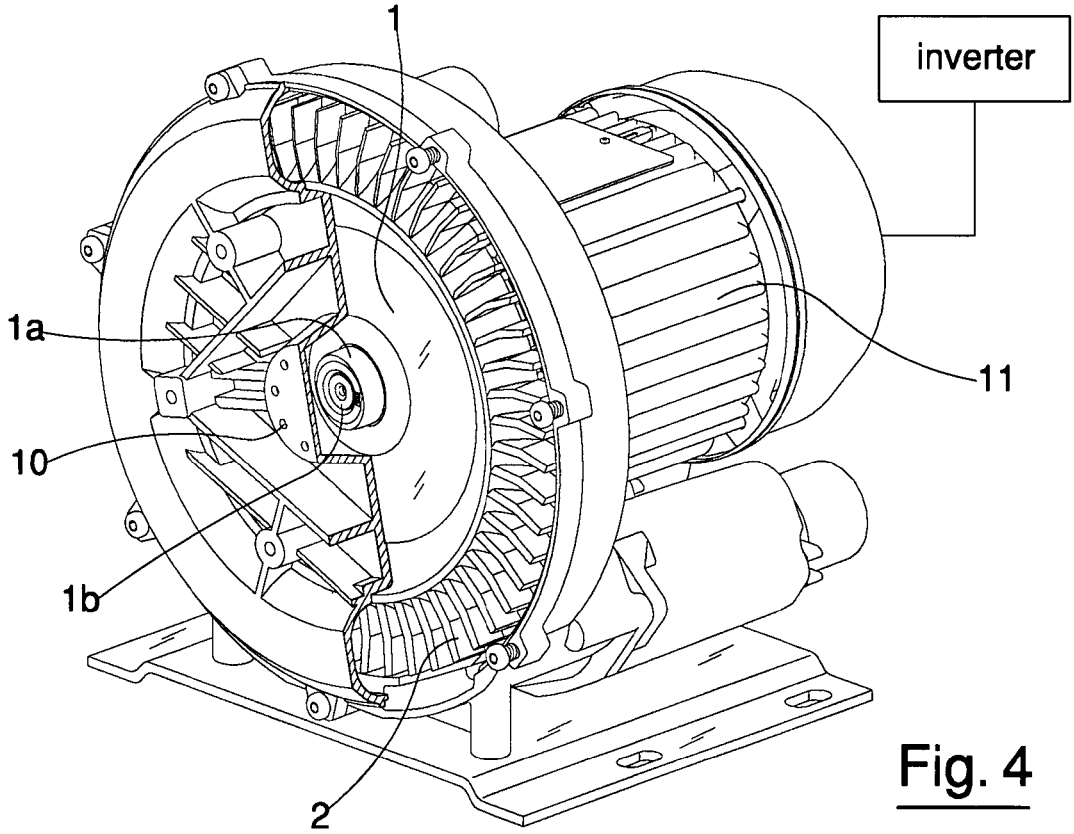
Fig. 4

ROTARY VACUUM BLOWER

BACKGROUND OF THE INVENTION

The invention concerns a machine, having a lateral channel and often termed air-ring blowers, comprising an impeller provided with a central body to which peripheral blades are connected. The impeller is closed in a casing which defines a circumferential annular conduit, arranged on the external circumference of the casing, in which the impeller blades rotate. The annular conduit exhibits an intake mouth, through which a fluid is aspirated and enters the machine, and a delivery mouth through which the fluid is expelled from the machine itself.

These machines can function either as vacuum pumps or as compressors. In the first case the induction mouth is connected to the environment where a depression is to be created and the delivery mouth is generally connected to the external atmosphere; while in the second case the induction mouth is generally connected to the external atmosphere and the delivery mouth is connected to the environment where an overpressure is to be created. In both cases the pressure at the induction mouth is lower than the pressure at the delivery mouth, so there exists a $\Delta p$ between the zone where the induction mouth is and the zone where the delivery mouth is.

The annular conduit exhibits a first tract, which, following the advancement direction of the blades in the conduit, goes from the induction mouth to the delivery mouth, and a second tract, which goes from the delivery mouth to the induction mouth. The first tract has a transverse passage section having greater dimensions than that of the second tract. More precisely, each blade fits the second tract snugly, i.e. it passes at a very tiny distance from the internal walls of the second tract; preferably this distance is the tiniest possible, compatibly with friction problems, so as to prevent fluid passage between the two mouths through the second tract. Between the internal walls of the first tract and the blades a much larger free space is left, wherein turbulent fluid movement can take place.

During operation, the dynamic action of the blades generates a fluid current in the first tract of the annular conduit from aspiration to delivery. The conformation of the annular conduit, and in particular the presence of the free space between the blades and the internal walls of the first tract of the annular conduit is necessary in order for the motion of the blades to effectively give rise to a current of fluid from induction to expulsion.

The impeller is keyed on a shaft, which is usually set in rotation by an electric motor and rotates internally of the casing. At the lower part of the channel the blades of the impeller rotate in, an annular slit is afforded which enables passage of the body of the impeller internally of the casing. Between the internal part of the annular slit and the body of the impeller as small a space as possible must be left, compatibly with the problem of friction, in order to prevent passage of fluid from the channel to the internal part of the casing where the impeller shaft is located. In other words, as far as possible, fluid passage between the delivery and intake mouths, that is, between the zone where the delivery mouth is and the zone where the intake mouth is, should be prevented outside of the lateral channel and in an opposite direction to the direction of the motion of the blades.

However careful the mechanical construction may be, however, it is still inevitable that owing to the difference in pressure between the machine delivery mouth zone and the machine intake mouth zone there is a slight fluid leakage between casing and impeller body, in the opposite direction to the direction determined by the blade action, between the two zones. There is, effectively, always a small amount of fluid which is circulated and re-circulated. This causes the machine temperature to rise, especially in the casing which, if not properly cooled from outside, can reach 90-95° C. and beyond, in the largest machines, temperatures at which it is necessary to shut the machine down.

To limit this drawback the machines have to be installed in airy places so that an excessive temperature rise is prevented. Sometimes, however, in the warm seasons, the machine still has to be shut down during long periods of operation.

The main aim of the present invention is to provide a machine of the type described in which the danger of excessive heating is prevented or at least reduced to a minimum.

A further aim of the present invention is to realise a machine in which there are no significant differences in performance with respect to existing machines.

An advantage of the invention is that it attains the above aims in a constructionally simple and economic way.

A further advantage is that the invention can easily be applied to machines of known type.

SUMMARY OF THE INVENTION

The machine comprises an impeller, set in rotation by a motor of known type, provided with blades and closed in a casing which defines a circumferential annular conduit in which the blades turn. The annular conduit has a radially inward peripheral slot through which the impeller passes. The annular conduit exhibits two openings, respectively an induction mouth for aspirating fluid from outside the machine, and a delivery mouth from which the fluid exits from the machine. The machine also comprises a further opening which is neither the induction mouth nor the delivery mouth, afforded on the casing and defining a passage which places an inside of the casing in communication with an outside environment.

BRIEF DESCRIPTION OF THE DRAWINGS

Further characteristics and advantages of the present invention will better emerge from the detailed description that follows of a preferred embodiment of the invention, illustrated by way of non-limiting example in the figures of the drawings, in which:

FIG. 2 is a front view in vertical elevation of the machine of the invention, from which the front cover of the casing has been removed;

FIG. 4 is a perspective view, with some parts sectioned, of the machine of the invention.

DESCRIPTION OF THE PREFERRED EMBODIMENTS

Figure 3:
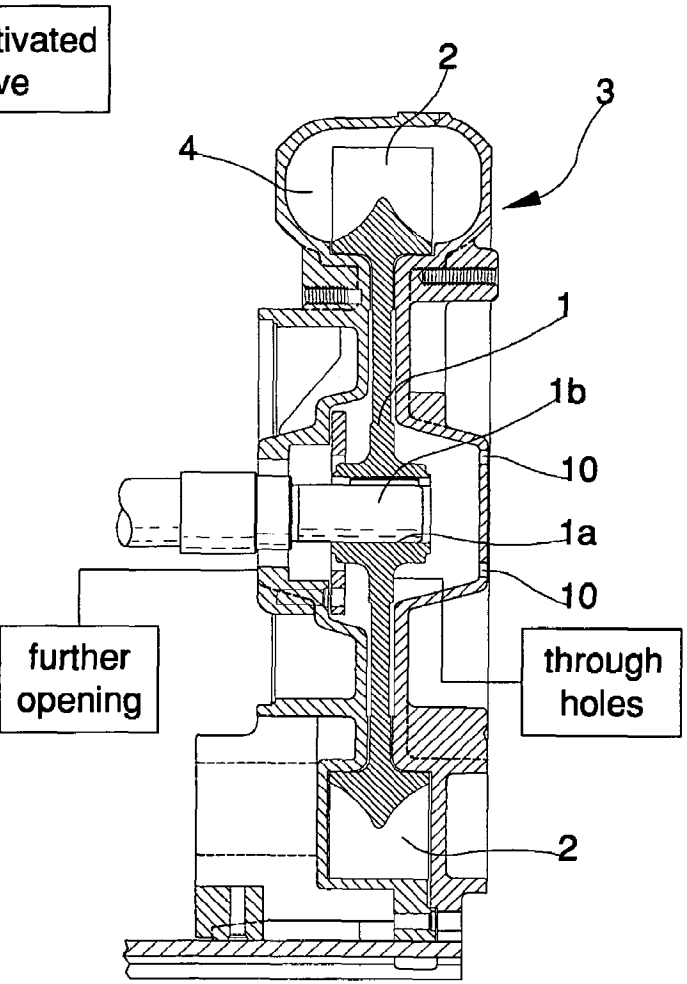
FIG. 3 is a section made according to line III-III of FIG. 1.

The machine comprises, as in known machines of this type, an impeller 1 which is provided with a hub 1*a* keyed on a shaft 1*b* which is rotated by a motor of known type, such as for example and electric motor 11; the impeller 1 exhibits a central body on which peripheral blades 2 are set.

The impeller is closed in a casing 3 which defines a circumferential annular conduit 4 in which the blades 2 of the impeller rotate. The casing is normally made in two parts, one of which is connected to the electric motor and the other of which constitutes a front cover; the structure of the casing is obtained by sealedly fastening the two component parts thereof together. The annular conduit 4 exhibits two openings, respectively an intake mouth 5 for aspirating fluid from outside the machine and a delivery-mouth 6 for enabling exit of the fluid from the machine; by action of the impeller blades, the fluid (normally air) is aspirated by the intake mouth 5 and, after having crossed the annular conduit 4, is expelled through the delivery mouth 6.

The machine of the invention can operate, as known-type machines with the same operating principle, both as a vacuum pump and as a compressor. In the first case, the intake mouth 5 is connected to the ambient in which a vacuum is to be created and the delivery mouth is connected to the external environment, while in the second case the intake mouth is connected to the external environment and the delivery mouth is connected to the ambient where an overpressure is to be created.

The machine comprises, apart from the intake and delivery mouths 5 and 6, at least a further opening which is afforded on the casing 3 and which defines a passage enabling the inside of the casing to be placed in communication with the external environment. In particular, this further opening is advantageously afforded on the casing 3 in a zone 3*a* of the casing which is internal of the annular conduit 4. In other words, the further opening afforded in the casing enables the part of the casing not connected with the circumferential conduit 4 to be placed in communication with the external environment; this is the part of the casing that contains the central body of the impeller.

Advantageously, for reasons that will be better described hereinafter, the further opening is afforded on the part of the body where the hub of the impeller is located, i.e. in the central part of the casing. As the casing is made in two parts, and as the cover of the casing is completely free towards the external environment, the further opening is advantageously afforded on the cover itself.

Figure 1:
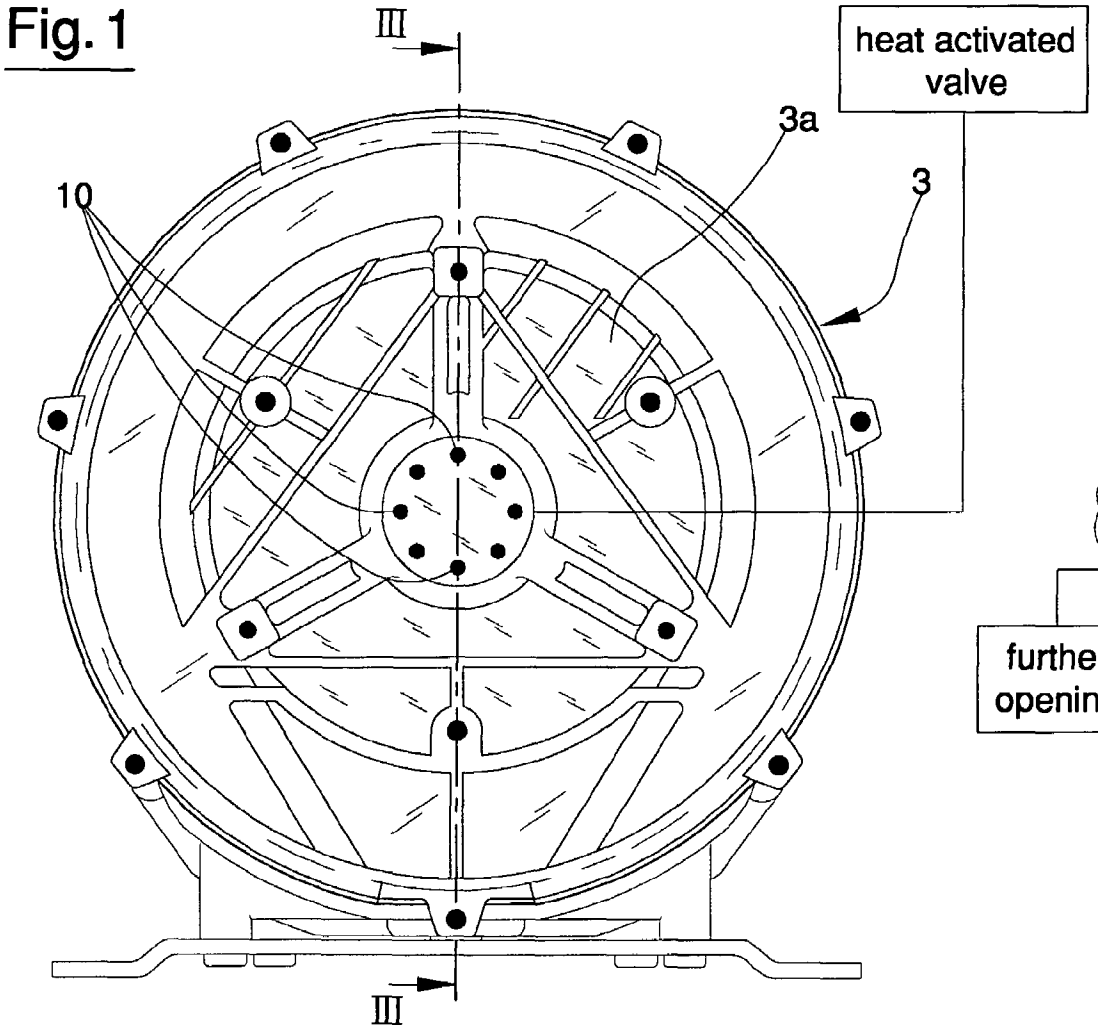
FIG. 1 is a front view in vertical elevation of the machine.

It is advantageous, and very simple to realise, for the further opening to be fractioned and made in a plurality of through holes 10 made on a circumference arranged, as can be seen in FIG. 1, on the casing, at the position of the hub 1*a* of the impeller.

The size of the passage of the opening can be fixed, as illustrated for example in the figure of the drawing, or, for reasons that will be more fully explained herein below, can be regulated by total or partial occlusion of one or more of the through holes. For example, caps can be included to occlude one or more of the through holes, or a rotary obturator can be included, arranged in front of the holes 10. All of these devices are, however, of known type.

Especially if the further opening is made with a single through hole made in the casing, the size of the passage of the further opening can be regulated by means for regulating, also of known type, such as for example one or more valves that are thermally operated, or timed to open and close.

If the seals between the central body of the impeller and the casing are perfect, in the central zone of the casing, i.e. the part not in communication with the annular channel 4, there should be no fluid circulation. However, as previously mentioned, notwithstanding the care taken in manufacturing the casing and the impeller, there will always be a minimum of space through which, due to the difference in pressure between the machine zones comprising the delivery mouth and the intake mouth, there will be a slight fluid return in the opposite direction to the one determined by the blade action. The fluid which leaks back and enters the central zone of the casing, which in known machines crosses the central zone at a greater pressure towards the low pressure zone of the machine, is recirculated several times, with a consequent raising of the machine temperature, and in particular of the casing.

In the machine of the invention, when functioning as a compressor, i.e. with the intake mouth at atmospheric pressure and the delivery mouth in overpressure, the modest quantity of fluid that leaks, through the small space between the impeller and the body, from the zone in overpressure to the zone at atmospheric pressure, is not recirculated but exits through the further opening (in the figures represented by the holes 10). The further opening is internal of the casing in overpressure, with an intermediate overpressure value of between atmospheric pressure and the delivery mouth pressure, and external of the casing at atmospheric pressure. The fluid entering the zone of the delivery mouth thus encounters lower resistance to exiting through the further opening and proceeding towards the zone of the intake mouth; in this way there is no re-circulation of fluid and machine heating-up is much less. Similarly, in the machine of the invention, when functioning as a vacuum pump, i.e. with the delivery mouth at atmospheric pressure and the intake mouth in depression, the modest quantity of fluid which through the small space between the impeller body and the casing would enter the zone at atmospheric pressure and go towards the zone in depression, does not now enter the zone at atmospheric pressure but is recalled towards the further opening. Internally of the casing, the further opening is in depression with an intermediate depression value between the atmospheric pressure and the pressure at the intake mouth, and externally of the casing at atmospheric pressure; the fluid therefore encounters less resistance to being recalled through the further opening than to going towards the delivery mouth. This means there is no recirculation of fluid, but instead there is an aspiration of fluid across the further opening; machine heating-up is strongly limited by this. In particular, the arrangement of the holes 10 and impeller hub la, through which holes the further opening is afforded, more greatly limits machine heating in the zone in which the turning organs of the impeller shaft are located.

To obtain the described effects, the outlet size of the further opening advantageously is slightly bigger than the space between the central body of the impeller and the casing; the size of the surface, not easily determinable with precision and variable from machine to machine, can in any case easily be determined with a brief series of practical tests effected on a machine prototype. It is however stressed that the size of the surface is not critical inasmuch as the desired effects are obtained with quite differing values, as the flow of fluid through the further opening is anyway limited by the narrow passage between the impeller body and the casing.

By including the further opening reductions in increase of machine temperature can be obtained of the order, in average-sized machines in which the temperature might otherwise reach 90° C., of 20-25° C. In other words, the temperature of these machines can be kept at something below 70-75° C.

Machine head is only very minimally limited by the invention, especially in the face of the temperature reductions obtained. The amount of fluid passing through the further opening is very limited.

To reduce the loss of head, instead of the through holes 10 (but losing the extreme simplicity their inclusion affords) other further openings, with mechanically controlled passage, could be used: for example, thermal control or timed control could be used, so that the section of the further opening can be mechanically changed, or opened only at certain times, or when the temperature reaches a certain level.

An extremely effective way of reducing the small leak, up to its elimination, is by providing an electric motor 11 which places the impeller in rotation, by means of an inverter of known type, which enables a variation to be applied in the frequency of supply voltage. In this way, if necessary the motor rotation speed can be changed, as it depends on the voltage supply frequency and the machine impeller. By increasing the impeller rotation speed the machine head can be increased, to compensate if necessary for the small loss of head caused by the presence of the further opening.

In some special cases, for example in machines destined to operate on fluids at high temperature, it is possible, in order to keep the temperature down in the zones where the shaft rotating elements are located, to make further openings on the part of the casing located at the hub 1*a* of the impeller, and on the cover of the casing which is connected to the electric motor; in other words further openings are made on the casing on opposite sides to the impeller.

In the latter case it is advantageous to afford through-holes in the internal part of the impeller, for example by realising spokes which place the further openings made on opposite sides of the impeller in direct communication. This solution is not illustrated in the figures of the drawings.

In this way the temperature in the zone where the shaft rotating organs are located is kept a lower level, not only because of the action of the further openings as described above, but also due to the action of an external air draught which, passing through the openings made on the casing and the holes made in the central part of the impeller, considerably contribute to cooling the zone.

Obviously a solution of this type leads to greater loss of head, which can however be at least partially recuperated by the above-described means. The modest disadvantages of the loss of head are however compensated for by the considerable advantage of having a low temperature around the rotating organs.

What is claimed is:

1. An improved rotary vacuum blower machine, comprising an impeller, provided with a hub keyed on a shaft adapted to be set in rotation by a motor, further provided with blades and closed in a casing which defines a circumferential annular conduit in which the blades turn, the annular conduit having a radially inward peripheral slot through which said impeller passes, the annular conduit exhibiting two openings, one of the two openings being an induction mouth for aspirating fluid from outside the machine, and a delivery mouth from which the fluid exits from the machine; comprising at least two further openings which are neither the induction mouth nor the delivery mouth, afforded on opposite sides of the casing with respect to the impeller and defining passages which place an inside of the casing in communication with an outside environment, wherein the further openings are afforded on the casing in a zone thereof which is radially inward of the annular conduit in a central part of the casing adjacent and in fluid communication with said hub, through holes being afforded on a central body of the impeller which through holes place the at least two further openings located on opposite sides of the impeller in direct reciprocal communication.

2. The machine of claim 1, wherein a size of the passage of one said further opening is regulated by means for regulating.

3. The machine of claim 2, wherein the size of the passage of the one said further opening is regulated by one or more heat-activated valves.

4. The machine of claim 1, wherein one said further opening is composed of a plurality of through holes made on a circumference arranged on the casing adjacent the hub of the impeller.

5. The machine of claim 1, in combination with the motor which sets the shaft in rotation and which comprises an electric motor powered by an inverter.

* * * * *